US010453440B1

(12) United States Patent
Kurz

(10) Patent No.: US 10,453,440 B1
(45) Date of Patent: Oct. 22, 2019

(54) ADAPTIVE NOISE FILTERING IN A LOCOMOTIVE ENVIRONMENT

(71) Applicant: Westinghouse Air Brake Technologies Corporation, Wilmerding, PA (US)

(72) Inventor: Brian E. Kurz, Germantown, MD (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 16/152,457

(22) Filed: Oct. 5, 2018

(51) Int. Cl.
*G10K 11/178* (2006.01)

(52) U.S. Cl.
CPC .. *G10K 11/17885* (2018.01); *G10K 11/17883* (2018.01); *G10K 2210/1283* (2013.01)

(58) Field of Classification Search
CPC ..... G10K 11/17885; G10K 11/17883; G10K 2210/1283; G10K 2210/105
USPC .... 381/71.4, 94.2, 71.14, 104, 103, 107, 58, 381/57
See application file for complete search history.

(56) References Cited

U.S. PATENT DOCUMENTS

2008/0159549 A1* 7/2008 Copley ..... G10K 11/178 381/58

OTHER PUBLICATIONS

"Fast Fourier Transform", Wikipedia, https://en.Wikipedia.og/wiki/Fast_Fourier_transform (Downloaded from Internet on Dec. 9, 2019).

"What's the Difference Between All These Audio Format, and Which One Should I Use?", Lifehacker, https://lifehacker.com/5927052/whats-the-difference-between-all-these-audio-formats-and-which-one-should-i-use (Downloaded from Internet on Dec. 9, 2019).

* cited by examiner

*Primary Examiner* — Paul Kim
*Assistant Examiner* — Ubachukwu A Odunukwe
(74) *Attorney, Agent, or Firm* — The Webb Law Firm

(57) ABSTRACT

A method of noise filtering on a locomotive includes converting sounds received by one or more transducer at first and second period of times into first and second electric signals and comparing a value of a signal that varies with operation, movement, or both of the locomotive to a reference value. When the signal value is one of less than or greater than the reference value during the first period of time, a controller stores a first unfiltered digitized version of the first sound in a memory. When the signal value is the other of less than or greater than the reference value during the second period of time, the controller stores in the memory a second, filtered digitized version of the second sound that is filtered in a frequency spectrum associated with the second sound.

19 Claims, 3 Drawing Sheets

ADAPTIVE NOISE FILTERING IN A LOCOMOTIVE ENVIRONMENT

BACKGROUND OF THE INVENTION

Field of the Invention

The present invention relates to recording sounds associated with the operation of a locomotive and, more particularly, to enabling certain sounds, such as the ringing of a locomotive bell, the sounding of a locomotive horn, or human speech occurring in the cab of the locomotive, to be distinguished from background noise that can occur during operation of the locomotive.

Description of Related Art

Locomotives can be equipped with audio and/or video recording devices that are strategically located to record audio and/or video events associated with the operation of the locomotive. In audio recordings acquired at times of relatively low background noise, sounds such as the locomotive bell ringing, the locomotive horn sounding, or human voices in the cab of a locomotive are readily distinguishable from the background noise. However, as the sound pressure level of the ambient noise increases, it can make difficult or impossible to hear the bell ringing, the horn sounding, or voices in the recording captured at such times during playback of the recording.

It would, therefore, be desirable to provide a method and apparatus that enables desired sounds, such as the bell ringing, the horn sounding, or human speech in the cab of the locomotive, to be heard when playing back of recordings acquired at a time of relatively high background noise.

SUMMARY OF THE INVENTION

Generally, provided is a method for filtering from ambient sound unwanted background noise associated with the operation of a locomotive to isolate specific sounds and then record the filtered sound for optional playback at a later time.

According to one preferred and non-limiting embodiment, the ambient sound is filtered to isolate and record locomotive horn sounds, bell sounds, and/or sounds (e.g., voices) in a cab of a locomotive. Via said isolation, the present invention overcomes disadvantages of existing methods of recording wherein the sounds of a horn, bell, and/or voices in a cab can be drowned out by background noise, e.g., wind noise, train background noise (e.g., engine noise, dynamic braking resistor banks), human speech (other than voices in the cab), etc.

In one preferred and non-limiting embodiment or example, the current throttle setting of the locomotive can be used to determine when to filter out background noise associated with operation of the locomotive.

In one preferred and non-limiting embodiment or example, the current and/or anticipated speed of the locomotive can be used to determine when to filter out background noise associated with operation of the locomotive.

In one preferred and non-limiting embodiment or example, an accelerometer can be provided to detect acceleration and, optionally, calculate speed to enable filtering out of background noise associated with operation of the locomotive.

In one preferred and non-limiting embodiment or example, brake commands can be used filter out brake system air venting noise.

In one preferred and non-limiting embodiment or example, noise cancelling can be used to filter out background noises at desired frequencies or frequency bands. Non-limiting examples of desired frequencies that can be filtered include frequencies associated with the following: (1) train background noises (engine noise and noise associated with the use of dynamic braking resistor banks); (2) wind noise; and/or (3) human speech.

Further preferred and non-limiting embodiments or examples are set forth in the following numbered clauses.

Clause 1: A method of noise filtering on a locomotive comprising: (a) converting, by a first transducer, a first ambient (analog) sound at a first sound pressure level received by the first transducer during a first period of time (e.g., a first interval or duration of time) into a first analog electrical signal; (b) converting, by a second transducer, a second ambient (analog) sound at a second sound pressure level received by the second transducer during a second period of time (e.g., a first interval or duration of time) into a second analog electrical signal, wherein the second sound pressure level is greater than the first sound pressure level; (c) comparing, by a controller comprising one or more processors and memory, a value of a signal associated with operation, movement, or both of the locomotive during the first and second periods times to a reference value; (d) in response to the signal value being one of less than or greater than the reference value during the first period time, the controller storing in the memory a digitized version of the first analog electrical signal; (e) in response to the signal value being the other of less than or greater than the reference value during the second period time, the controller storing in the memory a digitized and filtered version of the second analog electrical signal.

Clause 2: The method of clause 1, wherein the value can be associated with at least one of the following: a control (e.g., throttle) setting of the locomotive, a speed of the locomotive, an acceleration of the locomotive, and/or a command (e.g., a brake command) of the locomotive.

Clause 3: The method of clause 1 or 2, wherein the digitized and filtered version of the second analog electrical signal can include frequencies filtered from a frequency spectrum associated with the second analog electrical signal.

Clause 4: The method of any one of clauses 1-3, wherein the frequencies filtered from a frequency spectrum associated with the second analog electrical signal can include frequencies associated with one or more of the following: wind noise; locomotive engine noise (during steady state operation, acceleration, or deceleration); and/or brake system air venting noise.

Clause 5: The method of any one of clauses 1-4, wherein the first analog electrical signal can be a time domain representation of the first ambient (analog) sound.

Clause 6: The method of any one of clauses 1-5, wherein: the second analog electrical signal can be a time domain representation of the second ambient (analog) sound; and step (e) can include: (e)(1) converting the second analog electrical signal from the time domain representation into a frequency domain representation; and (e)(2) filtering the frequency domain representation to suppress or remove one or more amplitudes and/or frequencies of the frequency domain representation.

Clause 7: The method of any one of clauses 1-6 can further include: (e)(3) storing the filtered frequency domain representation as the digitized and filtered version of the second analog electrical signal.

Clause 8: The method of any one of clauses 1-7 can further include: (e)(3) converting the filtered frequency domain representation into a filtered time domain representation thereof; and (e)(4) storing the filtered time domain representation of step (e)(3) as the digitized and filtered version of the second analog electrical signal.

Clause 9: The method of any one of clauses 1-8, wherein step (e)(1) can include determining a forward Fourier transform of the second analog electrical signal.

Clause 10: The method of any one of clauses 1-9, wherein step (e)(3) can include determining an inverse Fourier transform of the filtered frequency domain representation.

Clause 11: The method of any one of clauses 1-10 can further include converting, by an audio speaker, into audible sound at least one of the following: the digitized version of the first analog electrical signal, the digitized and filtered version of the second analog electrical signal, or both.

Clause 12: The method of any one of clauses 1-11, wherein the first transducer and the second transducer can be the same transducer.

Clause 13: The method of any one of clauses 1-12, wherein each transducer can be a microphone.

Clause 14: A method of noise filtering on a locomotive comprising: (a) converting, by a transducer, sound received by the transducer at first and second times into first and second electric signals, wherein a sound pressure level of the sound received by the transducer at the second time is greater than the sound pressure level of the sound received by the transducer at the first time, wherein each time can be an interval or duration of time, and the first time and the second time can be different or can partially overlap; (b) comparing, by a controller comprising one or more processors and memory, a value of a signal associated with operation, movement, or both of the locomotive to a reference value; (c) in response to the signal value being one of less than or greater than the reference value during the first time, the controller storing in the memory a first digitized version of the first sound; and (d) in response to the signal value being the other of less than or greater than the reference value during the second time, the controller storing in the memory a second digitized version of the second sound that is filtered in a frequency spectrum associated with the second digitized version of the second sound.

Clause 15: The method of clause 14, wherein the first digitized version of the first sound includes an unfiltered frequency spectrum associated with the first sound.

Clause 16: The method of clause 14 or 15, wherein the filtered frequency spectrum of step (d) can include at least one of the following: one or more amplitudes of the frequency spectrum of the second sound suppressed; one or more frequencies of the frequency spectrum of the second sound removed; or both.

Clause 17: The method of any one of clauses 1-16, wherein the one or more amplitudes can be suppressed at frequencies associated with one or more of the following: wind noise; locomotive engine noise (during steady state operation, acceleration, or deceleration); and/or brake system air venting noise.

Clause 18: The method of any one of clauses 1-17, wherein the one or more removed frequencies can be removed at frequencies associated with one or more of the following: wind noise; locomotive engine noise (during steady state operation, acceleration, or deceleration); and/or brake system air venting noise.

Clause 19: The method of any one of clauses 1-18 can further include converting, by an audio speaker, into sound at least one of the following: the first digitized version of the first sound, the second digitized version of the second sound, or both.

BRIEF DESCRIPTION OF THE DRAWINGS

These and other features of the present invention will become apparent from the following description in which references made to the appended drawings wherein.

DESCRIPTION OF THE INVENTION

Figure 1:
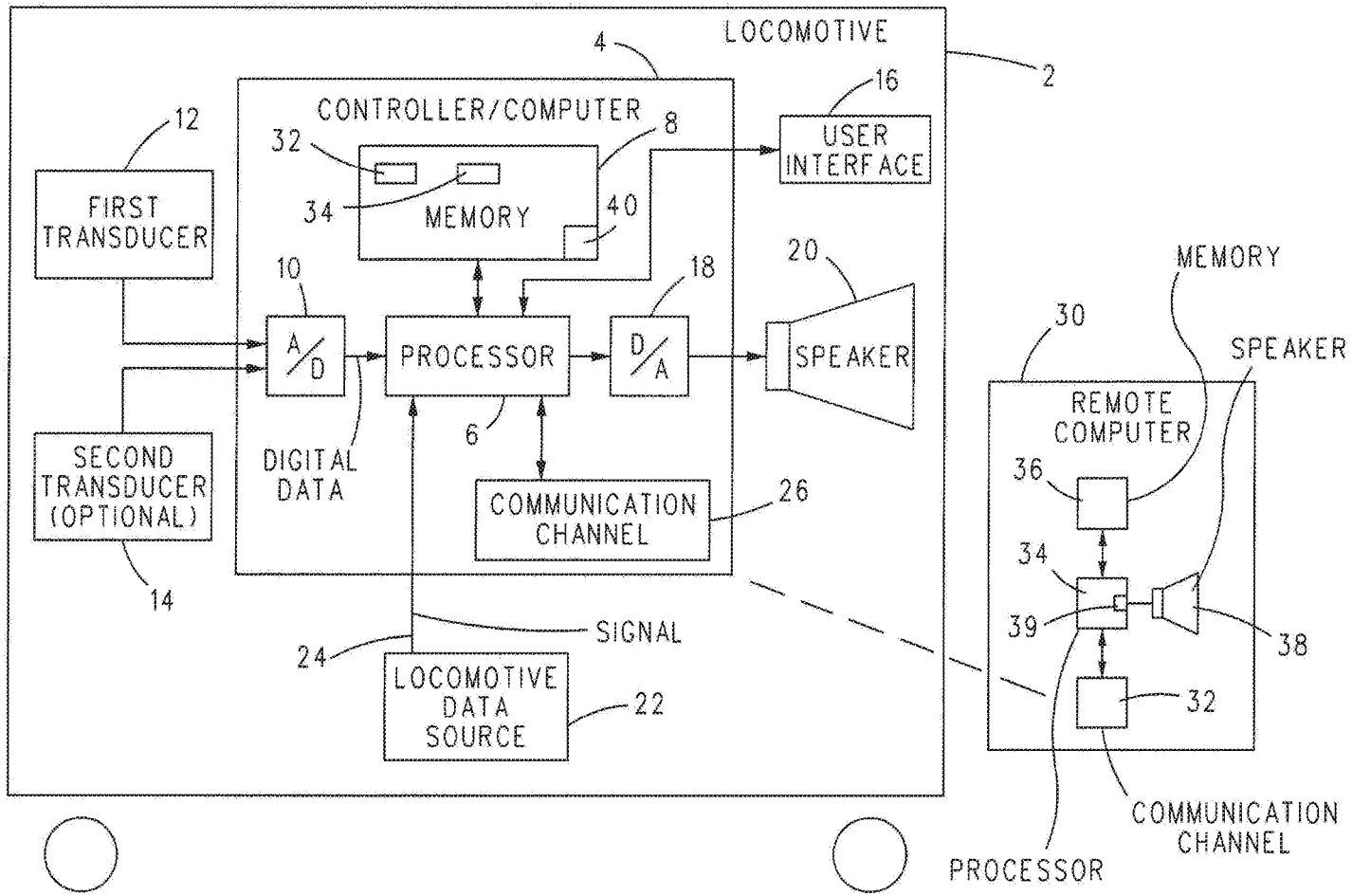
FIG. 1 is a schematic view of a locomotive in accordance with the principles of the present invention.

Various non-limiting examples will now be described with reference to the accompanying figures where like reference numbers correspond to like or functionally equivalent elements.

For purposes of the description hereinafter, the terms "end," "upper," "lower," "right," "left," "vertical," "horizontal," "top," "bottom," "lateral," "longitudinal," and derivatives thereof shall relate to the example(s) as oriented in the drawing figures. However, it is to be understood that the example(s) may assume various alternative variations and step sequences, except where expressly specified to the contrary. It is also to be understood that the specific example(s) illustrated in the attached drawings, and described in the following specification, are simply exemplary examples or aspects of the invention. Hence, the specific examples or aspects disclosed herein are not to be construed as limiting.

With reference to FIG. 1, in one preferred and non-limiting embodiment or example, a locomotive 2 can include a controller (or computer) 4 that includes one or more processors 6 and memory 8. In one preferred and non-limiting embodiment or example, memory 8 can include non-volatile memory, such as flash memory (ROM) or a hard drive, which can be utilized for long-term storage of programs and/or data, and volatile memory, such as RAM, which can be used for short-term storage of programs and/or data during operation of processor 6. Controller 4 can be programmed or configured to operate in the manner described hereinafter and, more particularly, processor 6 can operate in accordance with a program stored in memory 8 in the manner described hereinafter. The operation of processor 6 operating under the control of a program stored in memory 8 is conventional and well-known in the art and will not be described further herein.

Controller 4 can include an analog-to-digital convertor (A/D) 10 for converting an analog electrical signal output by a first transducer 12 into corresponding digital data for processing by processor 6 in the manner described hereinafter. In one preferred and non-limiting embodiment or example, A/D 10 can also be configured to process the output of a second, optional transducer 14 into corresponding digital data for processing by processor 6 in the manner described hereinafter.

In one preferred and non-limiting embodiment or example, a user interface 16 can be provided to enable a user to interface with a program running on processor 6. In an example, user interface 16 can include a visual display and a means for entry of data and/or commands into processor 6.

In an example, the means for entry of data and/or commands can include the display being a touch panel display. In another example, the means for entry of data and/or commands can include a mouse and/or a keyboard. The particular implementation of the means for entering data and/or commands is not to be construed in a limiting sense.

In one preferred and non-limiting embodiment or example, controller 4 can also include a digital-to-analog convertor (D/A) 18 which can convert digital data output by processor 6 into an analog signal which can be provided to a speaker 20 or other device capable of converting the analog signal into audible sound.

In one preferred and non-limiting embodiment or example, locomotive 2 can also include a locomotive data source 22 which can be operative for outputting to processor 6 a signal 24 having a value that can change with operation, movement, or both of locomotive 2. In one preferred and non-limiting embodiment or example, the value of signal 24 can change in response to one or more of the following: a change of the control (e.g., throttle) setting of the locomotive, a change in the speed of the locomotive, a change in the acceleration or deceleration of the locomotive, and/or a change in a (e.g., brake) command of the locomotive. However, this is not to be construed in a limiting sense.

In an example, locomotive data source 22 can include or be part of a positive train control that can process or output one or more control settings and/or commands for controlling the operation of locomotive 2. The speed and/or acceleration of the locomotive can be provided to controller 4 by suitable sensors known in the art, such as, for example, a speedometer, an accelerometer, a wheel revolution sensor, and the like. However, this is not to be construed in a limiting sense since it is envisioned that the value of signal 24 and/or any changes in the value of signal 24 can represent any operation and/or movement associated with locomotive 2 that can result in an increase in a volume of sound output by or associated with the operation of locomotive 2.

In one preferred and non-limiting embodiment or example, increasing the throttle setting of locomotive 2 can result in an increase in the background noise within locomotive 2, for example, within the cab of the locomotive. In another example, increasing the speed of locomotive 2 can result in an increase in the background noise within locomotive 2 due to engine noise, increased wind noise, and/or vibration. In another example, increasing acceleration of locomotive 2 can result in an increase in the background noise in locomotive 2 due to engine noise, increased wind noise, and/or increased vibration. In yet another example, outputting a brake command to increase the level of braking can result in an increase in the background noise within locomotive 2 due to the operation of the brakes, such as, for example, brake system air venting noise. These sources of the changing value of signal 24, however, are not be construed in a limiting sense since it is envisioned that the value of signal 24 and/or any changes in the value of signal 24 can be based on other operations, movements, or both of locomotive 2.

Finally, controller 4 can include a communication channel 26 which can be utilized to transfer data from controller 4 to a remote computer 30 for processing in a manner described hereinafter.

In one preferred and non-limiting embodiment or example, communication channel 26 can be of any suitable and/or desirable form and/or protocol that can be utilized to transfer data from controller 4 to remote computer 30. Non-limiting examples of communication channels can include a wireless connection, a wired connection, a data transfer port, such as, for example, a USB port, and the like. The particular implementation of communication channel 26 for transferring data to remote computer 30 is not to be construed in a limiting sense.

In one preferred and non-limiting embodiment or example, each of first transducer 12 and optional second transducer 14 can be a microphone. However, this is not to be construed in a limiting sense since any device now known or hereinafter developed capable of converting sound into electrical signals can be used for first transducer 12, optional second transducer 14, or both.

Having thus described one preferred and non-limiting embodiment or example system comprising controller 4, first transducer 12, optional second transducer 14, user interface 16, speaker 20, and locomotive data source 22, methods of noise filtering on locomotive 2 using said system will now be described.

In one preferred and non-limiting embodiment or example, a method of noise filtering on locomotive 2 can include first transducer 12 converting first and second sounds received by first transducer 12 at first and second periods of time into first and second electrical signals. In this example, the sound pressure level of the second sound received by first transducer 12 during the second period of time can be greater than the sound pressure level of the first sound received by first transducer 12 during the first period of time. However, this is not to be construed in a limiting sense.

The first and second electrical signals output by first transducer 12 can be analog signals which can be converted by A/D 10 into digital data for processing and storage in memory 8 by processor 6. Herein, each of the first period of time and the second period of time can be any interval and/or duration of time deemed suitable and/or desirable. In an example, the first period of time and the second period of time can be different or can partially overlap.

In one preferred and non-limiting embodiment or example, controller 4, and, in particular, processor 6 can compare the value of signal 24 output by locomotive data source 22 (associated with operation, movement, or both of the locomotive) to a reference value 40 which can be stored in memory 8. In response to determining that the value of signal 24 is one of less than or greater than reference value 40 during the first period of time where the first sound pressure level is, for example, less than a threshold associated with reference value 40, controller 4 can store a first digitized version of the first sound 32 in memory 8.

In one preferred and non-limiting embodiment or example, in response to the value of signal 24 being the other of less than or greater than reference value 40 during the second period of time when the second sound pressure level is, for example, greater than the threshold associated with reference value 40, controller 4 can store in memory 8 a second digitized version of the second sound 34 that can be filtered in a frequency spectrum associated with the second digitized version of the second sound. In an example, the first digitized version of the first sound 32 can be unfiltered in the frequency spectrum associated with said first digitized version of the first sound 32. In contrast, the second digitized version of the second sound 34 can be filtered in a frequency spectrum associated with the second digitized version of the second sound.

In one preferred and non-limiting embodiment or example, the reasoning for storing the first, unfiltered digitized version of the first sound 32, and, separately, storing the second, filtered digitized version of the second sound 34 is as follows. The sound pressure level of the first sound received by first transducer 12 during the first period of time can be of a sufficiently low level whereupon one or more sounds associated with the operation and/or movement of locomotive 2 that can be desired to be recorded are not masked by background noise. Examples of sounds that can be desired to be recorded include the bell ringing, the horn sounding, and/or human speech occurring in the locomotive cab. However this is not to be construed in a limiting sense.

In contrast, the second sound pressure level of the second sound received by first transducer 12 during the second period of time can be of a sufficiently high level that includes background noise that can mask sounds associated with the operation and/or movement of locomotive 2 that can be desired to be recorded. Examples of such background noise can include wind noise; locomotive engine noise occurring during steady state operation, acceleration, or deceleration; and/or brake system air venting noise. However, this is not to be construed in a limiting sense since it is envisioned that other background noise sources associated with the operation and/or movement of locomotive 2 can mask sounds desired to be recorded.

In one preferred and non-limiting embodiment or example, the reference value 40 stored in memory 8 can set a threshold for filtering or not filtering sound received by first transducer 12 based on the value of signal 24 output by locomotive data source 22. By way of the value of signal 24 and reference value 40 stored in memory 8, the decision whether to filter or not filter digitized versions of sounds received by first transducer 12 can be based on operation, movement, or both of locomotive 2 without reference to the amplitudes of signals output by first transducer 12. In an example, the decision to store a filtered or an unfiltered digitized version of any sound in memory 8 can be preemptive. For example, the value of signal 24 can be based on the throttle setting of locomotive 2. Increasing the throttle setting to increase the speed of locomotive 2 will, eventually, result in an increase in the sound pressure level (SPL) of the sound and, hence, the background noise detected by first transducer 12. Accordingly, upon the value of signal 24 increasing (or decreasing) above (or below) reference value 40 in response to increasing the throttle setting (for example), the digitized version of the second sound received by first transducer 12 can be digitized and filtered in a frequency spectrum associated with the anticipated background noise to be produced by locomotive 2 operating at the higher throttle setting, and this second, filtered digitized version of the second sound 34 can be stored in memory 8. The second, filtered digitized version of the second sound 34 can include one or more amplitudes suppressed at frequencies associated with background noise, whereupon desired sounds associated with operation of locomotive 2 can be recorded without being masked by background noise.

In another example, if the value of signal 24 decreases (or increases) below (or above) reference value 40, controller 4 can store the first, unfiltered digitized version 32 of the first sound received by first transducer 12 in memory 8. In this manner, where unwanted background noise is predetermined to be at a level that does not interfere with recording of desired sounds to be recorded (associated with the operation of locomotive 2), an unfiltered frequency spectrum of the sound received by first transducer 12 can be recorded.

In one preferred and non-limiting embodiment or example, as would be appreciated by one of ordinary skill in the art, the process of converting an analog signal to a digital format (compressed or uncompressed) and converting the digital format back into an analog signal may naturally result in filtering of amplitudes and/or frequencies associated with the frequency spectrum of the original analog signal. Accordingly, herein when discussing an "unfiltered" digitized version of a sound received by a transducer, it is to be understood that such unfiltered digitized version is not further filtered over any filtration that may naturally occur during the process of converting the original analog sound into a digital format and then converting the digital format back into an analog sound. Moreover, when discussing a "filtered" digitized version of a sound received by a transducer, it is to be understood that such filtration is intentional beyond any filtration that may naturally occur during the process of converting an analog signal into a digital format and then converting the digital format back into an analog signal.

With continuing reference to the above example, in one preferred and non-limiting embodiment or example, the first, unfiltered digitized version of the first sound 32 can include an unfiltered frequency spectrum. In one preferred and non-limiting embodiment or example, the second, filtered digitized version of the second sound 34 can include at least one of the following: one or more amplitudes of a frequency spectrum of the digitized version of the second sound suppressed; one or more frequencies of the frequency spectrum of the digitized version of the second sound removed; or both. In an example, the one or more frequencies can be removed and/or the one or more amplitudes can be suppressed at frequencies associated with background noise associated with the operation of locomotive 2.

In one preferred and non-limiting embodiment or example, the sound received by first transducer 12 during the first period of time can be a first analog sound which first transducer 12 converts into a first analog electrical signal. Similarly, the sound received by first transducer 12 during the second period of time can be a second analog sound which first transducer 12 converts into a second analog electrical signal. Each of the first and second analog electrical signals output by first transducer 12 are time domain representations of the first and second analog sounds received by first transducer 12.

In one preferred and non-limiting embodiment or example, each of the first and second analog electrical signals is converted by A/D 10 into first and second digitized versions of the first and second analog electrical signals. In an example, in response to the value of signal 24 being less than (or greater than) reference value 40, the digitized version of the first analog electrical signal can be stored unfiltered in memory 8 as a digital representation of a time domain signal, sometimes referred to herein as the "first, unfiltered digitized version of the first sound 32". In another example, when the value of signal 24 is greater than (or less than) reference value 40, the digitized version of the second analog electrical signal can be converted into a frequency domain representation which can then be filtered in the frequency domain to suppress and/or remove one or more amplitudes and/or frequencies associated with unwanted background noise. The thus filtered frequency domain representation can then be stored in memory 8 in its present form or can first be converted back into a time domain representation which can then be stored in memory 8 as the second filtered digitized version of the second sound 34. Hence, as can be seen, the digitized and filtered version of the second analog signal can be stored in memory 8 as either a filtered frequency domain representation or a filtered time domain representation.

In one preferred and non-liming embodiment example, each digital representation of a time domain signal can be stored in an uncompressed format. In another example, each digital representation of a time domain signal can be stored in a compressed format that can be a lossless format, such as Free Lossless Audio Codec (FLAC), or a lossy format, such as MP3. However, this is not to be construed in a limiting sense.

In an example, each digital representation of a time domain signal that is stored in memory 8 in a compressed format can be decompressed by controller 4 (processor 6) prior to output to D/A 18. In contrast, each digital representation of a time domain signal that is stored in memory in an uncompressed format can be output directly to D/A 18. In an example, it is to be understood that each digitized version of an analog electrical signal output to D/A 18 can be provided directly to D/A 18 when stored in an uncompressed format in memory 8, or uncompressed and provided to D/A 18 when stored in memory 8 in a compressed format. For the purpose of simplicity of description, compression or lack of compression during storage in memory 8 of digitized versions of analog electrical signals, and decompression or lack of decompression during playback of digitized versions of the analog electrical signals will not be described further herein. However, it is to be understood that compression or decompression can be part of the storage and retrieval of digitized versions of analog electrical signals into and from memory 8.

In one preferred and non-limiting embodiment or example, when it is desired to convert the first, unfiltered digitized version of the first sound 32 stored in memory 8 back into audible sound, controller 4 (processor 6) can output said first, unfiltered digitized version of the first sound 32 to D/A 18 which can convert the same back into an analog electrical signal which can then be converted into audio sound by speaker 20. Similarly, if the second, filtered digitized version of the second sound 34 is stored in memory 8 as a time domain representation, controller 4 (processor 6) can output said second, filtered digitized version of the second sound 34 to D/A 18 which can convert the same back into an analog electrical signal which can be converted into audible sound by speaker 20.

In an example, if the second, filtered digitized version of the second sound 34 is stored in memory 8 as a frequency domain representation, this frequency domain representation can first be converted by controller 4 (processor 6) back into a digital time domain representation which can then be output to D/A 18 for conversion back into an analog electrical signal which can be converted to audible sound by speaker 20. In this example, the audible sound output by speaker 20 in response to receiving the analog electrical signal from D/A 18 can include sounds associated with unwanted noise suppressed or removed, whereupon desired sounds to be heard can be more pronounced.

In one preferred and non-limiting embodiment or example, controller 4 (processor 6) can use a discrete or fast Fourier transform (DFT or FFT) to convert the digitized version of the second, analog electrical signal output by A/D 10 from a distal time domain representation to a frequency domain representation. This frequency domain representation can then be filtered in a manner known in the art to suppress and/or remove one or more amplitudes and/or frequencies of its frequency spectrum.

In one preferred and non-limiting embodiment or example, and as noted above, the filtered frequency domain representation can be stored in memory 8 as the second, filtered digitized version of the second sound 34. Alternatively, prior to storage in memory 8, this filtered frequency domain representation can first be back-converted into a digital time domain representation which can then be stored in memory 8 as the second, filtered digitized version of the sound 34.

In the case where a DFT or FFT was performed on a digital time domain representation to convert it to a frequency domain representation stored in memory 8, at the time of playback of the second, filtered digitized version of the second sound 34 said frequency domain representation can be back-converted into a digital time domain representation using an inverse discrete or inverse fast Fourier transform (IDFT or IFFT). This digital time domain representation can then be converted by D/A 18 into an analog electrical signal which can be converted to audible sound by speaker 20.

In one preferred and non-limiting embodiment or example, a method of noise filtering in locomotive 2 can include utilizing second transducer 14 in addition to first transducer 12. In one preferred and non-limiting embodiment or example, first transducer 12 can be used to record sound when the value of signal 24 is below (or above) reference value 40 stored in memory 8 and second transducer 14 can be used to record sound when the value of signal 24 is above (or below) reference value 40 stored in memory 8. In one preferred and non-limiting embodiment or example, first and second transducers 12 and 14 can be positioned at different locations on locomotive 2 to optimize recording sounds of interest. For example, first transducer 12 can be located generally in the cab of locomotive 2 to receive sound present in said cab. In an example, second transducer 14 can be positioned on locomotive 2 at a location where second transducer 14 can more readily detect the locomotive bell ringing or the locomotive horn sounding. In an example, second transducer 14 can be positioned in proximity to the train operator (engineer) to detect the operator's voice. The foregoing locations of the first and second transducers 12 and 14, however, are not to be construed in a limiting sense.

In one preferred and non-limiting embodiment or example, the method of noise filtering on locomotive 2 that uses first transducer 12 and second transducer 14 can include first transducer 12 converting a first sound received by first transducer 12 at a first sound pressure level during a first period of time into a first analog electrical signal. Second transducer 14 can convert a second sound received by second transducer 14 at a second sound pressure level during a second period of time into a second analog electrical signal. The second sound pressure level can be greater than the first sound pressure level. The first period of time and the second period of time can be different or can partially overlap.

Controller 4 (processor 6) can compare the value of signal 24 related to operation, movement, or both of locomotive 2 during the first and second periods of time to reference value 40 stored in memory 8. In response to the value of signal 24 being less than (or greater than) reference value 40 during the first period of time, the first analog electrical signal can be digitized by A/D 10, and controller 4 (processor 6) can store in memory 8 a digitized version of the first, analog electrical signal. In an example, this digitized version of the first analog electrical signal can be unfiltered. This unfiltered, digitized version of the first analog electrical signal can be stored in memory 8 as a first, unfiltered digitized version of the first sound 32.

In response to the value of signal 24 being greater than (or less than) reference value 40 during the second period of time, controller 4 (processor 6) can store in memory 8 a digitized and filtered version of the second, analog electrical signal. The second analog electrical signal can be digitized by A/D 10 and filtered by controller 4 (processor 6). This filtered, digitized version of the second analog electrical signal can be filtered utilizing a suitable algorithm, such as a DFT or FFT, as a second, filtered digitized version of the second sound 34.

In one preferred and non-limiting embodiment or example, the second, filtered digitized version of the second sound 34 can be stored in memory 8 as a digital time domain representation of the second sound. In one preferred and non-limiting embodiment or example, the process of storing the second, filtered digitized version of the second sound 34 in memory 8 can include first converting it from a digital time domain representation into a frequency domain representation and then filtering the frequency domain representation to suppress and/or remove one or more amplitudes and/or frequencies of the frequency domain representation. In an example, this filtered frequency domain representation can be stored in memory 8 as the second, filtered digitized version of the second sound 34. In another example, prior to storage in memory 8, the filtered frequency domain representation can be back-converted, e.g., via an IDFT or IFFT, into a digital time domain representation which can then be stored in memory 8 as the second, filtered digitized version of the second sound 34. Conversion of the second, analog electrical signal from the digital time domain representation into the frequency domain representation can include determining a forward Fourier transform of the second analog electrical signal. The step of back-converting the filtered frequency domain representation to a time domain representation can include determining an inverse Fourier transform of the filtered frequency domain representation.

In one preferred and non-limiting embodiment or example, the second, filtered digitized version of the second sound 34 can include amplitudes and/or frequencies filtered from a frequency spectrum associated with the second analog signal.

In one preferred and non-limiting embodiment or example, the value of signal 24 or changes to the value of signal 24 can be based on at least one of the following: a control (throttle) setting or change of control setting of the locomotive; a speed or change in speed of the locomotive; an acceleration or change in acceleration of the locomotive; and/or a (brake) command or a change in a brake command of locomotive 2. The amplitudes and/or frequencies filtered from the frequency spectrum associated with the second analog electrical signal can include, for example, frequencies associated with one or more of the following: wind noise; locomotive engine noise during steady state operation, acceleration, or deceleration; and/or brake system air venting noise.

In one preferred and non-limiting embodiment or example, at a suitable time, speaker 20 can be utilized to convert into sound the first, unfiltered digitized version of the first sound 32, the second, filtered digitized version of the second sound 34, or both.

In one preferred and non-limiting embodiment or example, while this example described first transducer 12 and second transducer 14 as being separate transducers, it is envisioned, as in the previous example, that a single transducer (e.g., first transducer 12) can be utilized to implement the method. Stated differently, in connection with this example, the first transducer 12 and the second transducer 14 can be the same transducer.

Figure 2:
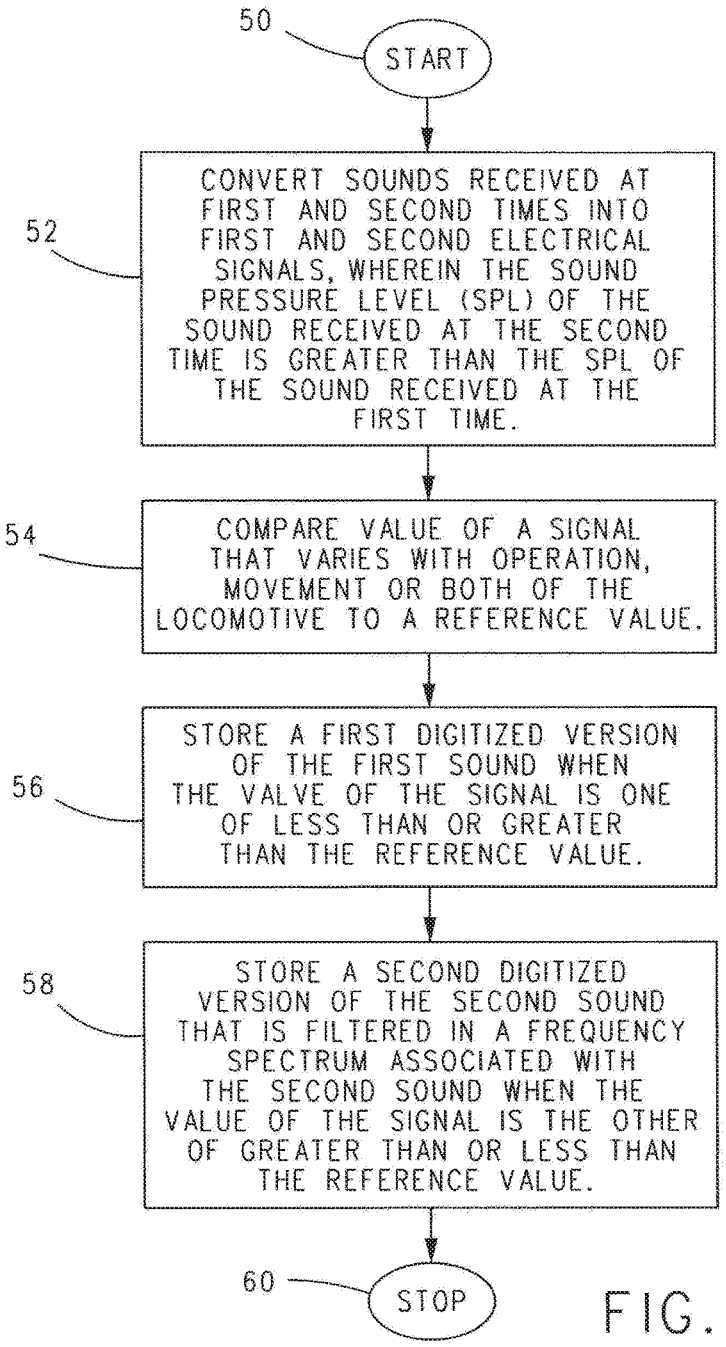
FIG. 2 is a flow diagram of a method in accordance with the principles of the present invention.

With reference to the flow diagram of FIG. 2, in one preferred and non-limiting embodiment or example, beginning from a start step 50, a method of noise filtering in accordance with the principles of the present invention advances to step 52, wherein sounds received at first and second times (e.g., intervals, durations, or periods of time) are converted into first and second electrical signals. In an example, the sound pressure level (SPL) of the sound received at the second time can be greater than the SPL of the sound received at the first time. In step 54, the value of a signal 24 that varies with operation and/or movement of locomotive 2 is compared to a reference value 40.

In step 56, a first digitized version of the first sound is stored in memory 8 when the value of signal 24 is one of less than or great than reference value 40. In step 58, a second digitized version of the second sound that is filtered in a frequency spectrum associated with the second sound is stored in memory 8 when the value of the signal 24 is the other of greater than or less than the reference value 40. The method then advances to stop step 60.

Figure 3:
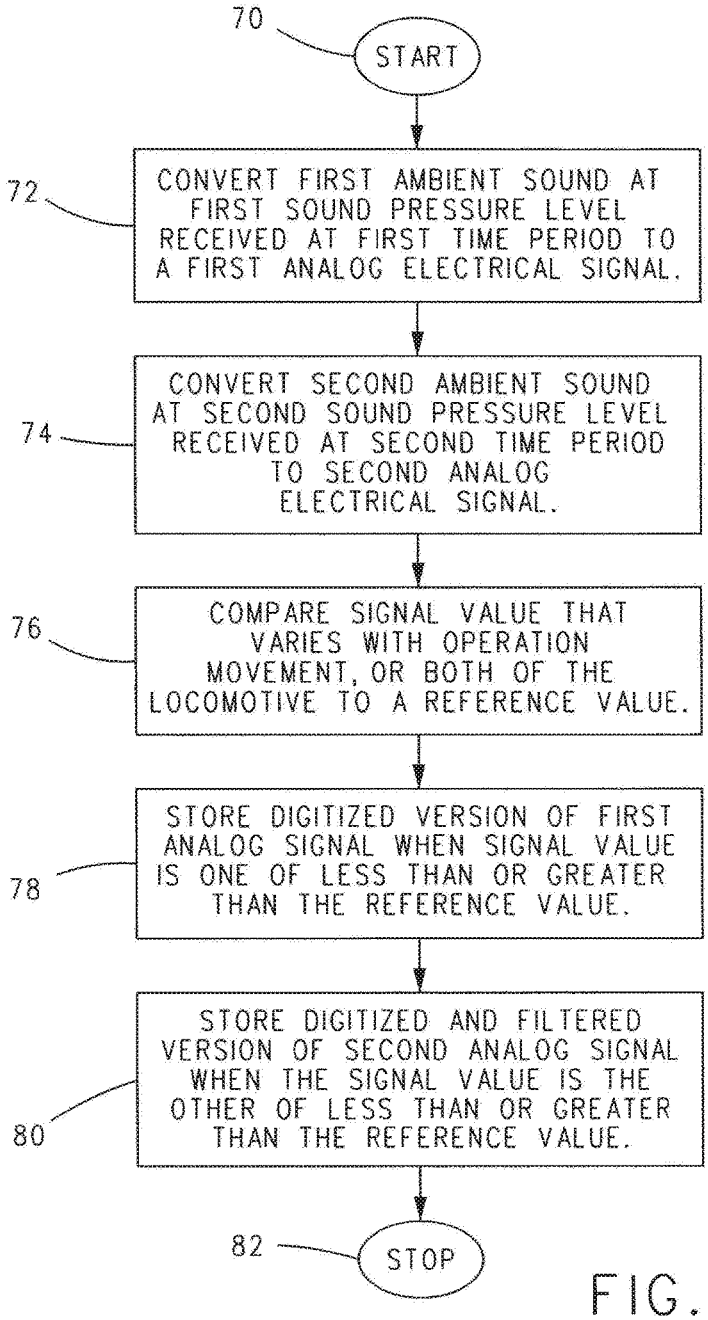
FIG. 3 is a flow diagram of a method in accordance with the principles of the present invention.

With reference to the flow diagram of FIG. 3, in one preferred and non-limiting embodiment or example, beginning from a start step 70, a method of noise filtering in accordance with the principles of the present invention advances to step 72, wherein a first ambient sound at a first sound pressure level received at a first time period is converted into a first analog electrical signal.

In step 74, a second ambient sound at a second sound pressure level received at a second time period is converted into a second analog electrical signal. In step 76, the value of a signal 24 that varies with operation and/or movement of locomotive 2 is compared with a reference value 40.

In step 78, a digitized version of the first analog signal is stored in memory 8 when the value of the signal 24 is one of less than or greater than the reference value 40. In step 80, a digitized and filtered version of the second analog signal is stored in memory 8 when the value of the signal 24 is the other of less than or greater than the reference value 40. The method then advances to stop step 82.

As can be seen, disclosed herein are methods of noise filtering on a locomotive 2. In each method, when the value of signal 24 is below (or above) reference value 40 stored in memory 8, a digitized unfiltered time domain version of the sound received by the transducer can be stored in memory 8. When the value of signal 24 is above (or below) reference value 40, a digitized and filtered frequency spectrum version of the sound received by the transducer or a filtered time domain version of the sound received by the transducer can be stored in memory 8. A benefit of storing a digitized, unfiltered version of the first analog electrical signal and a digitized, filtered version of the second analog electrical signal in memory 8 is that desired sounds of the locomotive bell, and/or horn, and/or voices in the cab of the locomotive can be reproduced from each said version while avoiding unwanted background noise from masking or drowning out the desired sounds.

Referring back to FIG. 1, in one preferred and non-liming embodiment example, if desired, each digitized, unfiltered version and/or digitized, filtered version of an analog electrical signal stored in memory 8 can be communicated or transferred to remote computer 30 via communication channel 26 of controller 4 and communication channel 32 of remote computer 30. The thus communicated or transferred digitized, unfiltered version and/or digitized, filtered version of an analog electrical signal can be stored in memory 36 of remote computer 30. In an example, a processor 34 of remote computer 30 can output any one or more of the digitized version and/or the digitized, filtered version of an electrical signal to a D/A 39 for conversion to an analog signal for playback by a speaker 38 of remote computer 30.

In an example, remote computer 30 can be a personal computer which can be programmed or configured to playback any digitized, unfiltered version or digitized, filtered version of an analog electrical signal produced by first transducer 12 and/or second transducer 14 remote from the environment of locomotive 2, e.g., for analysis of the sounds of locomotive 2 recorded during an incident.

Although the invention has been described in detail for the purpose of illustration based on what is currently considered to be the most practical preferred and non-limiting embodiments, examples, or aspects, it is to be understood that such detail is solely for that purpose and that the invention is not limited to the disclosed preferred and non-limiting embodiments, examples, or aspects, but, on the contrary, is intended to cover modifications and equivalent arrangements that are within the spirit and scope of the appended claims. For example, it is to be understood that the present invention contemplates that, to the extent possible, one or more features of any preferred and non-limiting embodiment, example, or aspect can be combined with one or more features of any other preferred and non-limiting embodiment, example, or aspect.

The invention claimed is:

1. A method of noise filtering on a locomotive comprising:

(a) converting, by a first transducer, a first ambient sound at a first sound pressure level received by the first transducer during a first period of time into a first analog electrical signal;

(b) converting, by a second transducer, a second ambient sound at a second sound pressure level received by the second transducer during a second period of time into a second analog electrical signal, wherein the second sound pressure level is greater than the first sound pressure level;

(c) comparing, by a controller comprising one or more processors and memory, a value of a signal associated with operation, movement, or both of the locomotive during the first and second periods of time to a reference value;

(d) in response to the signal value being one of less than or greater than the reference value during the first period of time, the controller storing in the memory a digitized version of the first analog electrical signal;

(e) in response to the signal value being the other of less than or greater than the reference value during the second period of time, the controller storing in the memory a digitized and filtered version of the second analog electrical signal.

2. The method of claim 1, wherein the value is associated with at least one of the following: a control setting of the locomotive, a speed of the locomotive, an acceleration of the locomotive, and/or a command of the locomotive.

3. The method of claim 1, wherein the digitized and filtered version of the second analog electrical signal includes frequencies filtered from a frequency spectrum associated with the second analog electrical signal.

4. The method of claim 3, wherein the frequencies filtered from a frequency spectrum associated with the second analog electrical signal include frequencies associated with one or more of the following: wind noise, locomotive engine noise, and/or brake system air venting noise.

5. The method of claim 1, wherein the first analog electrical signal is a time domain representation of the first ambient sound.

6. The method of claim 1, wherein:

the second analog electrical signal is a time domain representation of the second ambient sound; and step (e) includes:

(e)(1) converting the second analog electrical signal from the time domain representation into a frequency domain representation; and (e)(2) filtering the frequency domain representation to suppress or remove one or more amplitudes and/or frequencies of the frequency domain representation.

7. The method of claim 6, further including:

(e)(3) storing the filtered frequency domain representation as the digitized and filtered version of the second analog electrical signal.

8. The method of claim 6, further including:

(e)(3) converting the filtered frequency domain representation into a time domain representation thereof; and (e)(4) storing the time domain representation of step (e)(3) as the digitized and filtered version of the second analog electrical signal.

9. The method of claim 6, wherein step (e)(1) includes determining a forward Fourier transform of the second analog electrical signal.

10. The method of claim 8, wherein step (e)(3) includes determining an inverse Fourier transform of the filtered frequency domain representation.

11. The method of claim 1, further including converting, by an audio speaker, into sound at least one of the following: the digitized version of the first analog electrical signal, the digitized and filtered version of the second analog electrical signal, or both.

12. The method of claim 1, wherein the first transducer and the second transducer are the same transducer.

13. The method of claim 1, wherein each transducer is a microphone.

14. A method of noise filtering on a locomotive comprising:

(a) converting, by a transducer, sound received by the transducer at first and second times into first and second electric signals, wherein a sound pressure level of the sound received by the transducer at the second time is greater than the sound pressure level of the sound received by the transducer at the first time;

(b) comparing, by a controller comprising one or more processors and memory, a value of a signal associated with operation, movement, or both of the locomotive to a reference value;

(c) in response to the signal value being one of less than or greater than the reference value during the first time, the controller storing in the memory a first digitized version of the first sound; and (d) in response to the signal value being the other of less than or greater than the reference value during the second time, the controller storing in the memory a second digitized version of the second sound that is filtered in a frequency spectrum associated with the second sound.

15. The method of claim 14, wherein the first digitized version of the first sound includes an unfiltered frequency spectrum associated with the first sound.

16. The method of claim 14, wherein the filtered frequency spectrum of step (d) includes at least one of the following:

one or more amplitudes of a frequency spectrum of the second sound suppressed;

one or more frequencies of the frequency spectrum of the second sound removed; or both.

17. The method of claim 16, wherein the one or more amplitudes are suppressed at frequencies associated with one or more of the following: wind noise, locomotive engine noise, and/or brake system air venting noise.

18. The method of claim 14, wherein the one or more removed frequencies are removed at frequencies associated with one or more of the following: wind noise, locomotive engine noise, and/or brake system air venting noise.

19. The method of claim 14, further including converting, by an audio speaker, into sound at least one of the following: the first digitized version of the first sound, the second digitized version of the second sound, or both.

* * * * *